US005690168A

United States Patent [19]

Cizmar et al.

[11] Patent Number: 5,690,168

[45] Date of Patent: Nov. 25, 1997

[54] QUENCH EXCHANGER

[75] Inventors: Lloyd Edward Cizmar, Missouri City; Larry Gene Hackemesser; William E. Phillips, both of Houston, all of Tex.

[73] Assignee: The M. W. Kellogg Company, Houston, Tex.

[21] Appl. No.: 743,020

[22] Filed: Nov. 4, 1996

[51] Int. Cl.[6] ..... F28F 19/00

[52] U.S. Cl. ..... 165/134.1; 165/135; 165/154

[58] Field of Search ..... 165/134.1, 135, 165/154

[56] References Cited

U.S. PATENT DOCUMENTS

| | | | |
|---|---|---|---|
| 2,498,924 | 2/1950 | Keller | 165/134.1 |
| 4,457,364 | 7/1984 | Dinicolantonio et al. | 165/134.1 |
| 5,350,011 | 9/1994 | Sylvester | 165/135 |
| 5,579,831 | 12/1996 | Brucher | 165/134.1 |

FOREIGN PATENT DOCUMENTS 2551195 5/1977 Germany .

OTHER PUBLICATIONS

Babcock–Borsig "Borsig Linear Quencher (BLQ)—Turbo-flow", pp. 1–8, 1995.

*Primary Examiner*—Leonard R. Leo
*Attorney, Agent, or Firm*—John P. Ward

[57] ABSTRACT

A thermal transition section for introducing a high temperature cracked process gas into a quench exchanger having an inlet end comprising inner and outer concentric pipes connected to a closure ring to define an annulus between the pipes and an interior exchanger surface having an inside diameter. The transition section has a metal outer wall extending from a downstream end connected to the closure ring to an upstream end connected to a metal transition cone. The transition cone is connected at an upstream end to a line for supplying the process gas. The downstream end of the inner sleeve has an outside diameter matching the inside diameter of the interior exchanger surface. A precast, pre-fired single-piece ceramic insert substantially fills the annulus between the outer wall and inner sleeve. By using the ceramic insert, particularly a relatively long insert, thermal stresses are reduced and coke formation in the annulus is inhibited.

14 Claims, 5 Drawing Sheets

QUENCH EXCHANGER

FIELD OF THE INVENTION

This invention relates to an improved thermal transition section for a high temperature quench exchanger, and a method for assembling a thermal transition section for a high temperature quench exchanger.

BACKGROUND OF THE INVENTION

High temperature quench exchangers are used, for example, to cool the effluent from a cracking furnace. Such quench exchangers typically employ a double pipe construction with the high temperature cracking furnace effluent introduced into the interior pipe, and a cooling medium such as water circulated in the annulus between the exterior and interior pipes to make steam. The transfer line from the cracking furnace, however, is a single wall construction. Transitions between the transfer line and the quench exchanger must be designed for severe thermal stresses introduced by the extreme temperature differences between the quench exchanger and the transfer line.

Prior art inlet sections have used a transition cone which connects the transfer line to the quench exchanger. An inner sleeve was secured to the transition cone and extended downstream into the interior pipe of the quench exchanger, and a metal radiation shield was typically used between the inner sleeve and an exterior wall. This allowed the thermal stresses to be taken up in the exterior wall between the transition cone and the quench exchanger, and also allowed differential thermal expansion of the inner sleeve since the sleeve was not welded at the downstream end next to the interior wall of the quench exchanger. This introduced another problem, namely the accumulation of material in the annulus between the inner sleeve and the exterior wall of the transition section, and the formation of coke. This was typically addressed by introducing a steam purge of a relatively small flowrate into the annulus between the sleeve and the exterior wall of the transition section. The steam purge had a minimal cooling benefit, but generally served to displace hydrocarbon gases in the annulus section which were responsible for the coke formation. However, even with the steam purge, there were instances of problems due to maloperation or inadvertently leaving the steam purge off when commissioning a furnace following a shutdown. The resulting problems were normally cracked components due to thermal shock from the use of wet steam, or coke formation when steam was not commissioned per established operating recommendations. Eventual replacement of the transition section with a new transition section was normally required when these upsets occurred.

A thermal transition section designed for the severe conditions of the quench exchanger inlet which eliminates the use of purge steam would be an improvement. One commercially available gas inlet head, for example, uses a 3-layer refractory design to position refractory in the annulus between the inner sleeve and the exterior wall, with a gas-filled metal O-ring to seal the end of the inner sleeve with the interior pipe of the quench exchanger. This proprietary design is said to be superior to the traditional single layer design with regard to temperature and stress distribution.

SUMMARY OF THE INVENTION

The present invention uses a single piece ceramic insert between the inner sleeve and the exterior wall of the transition section at the inlet to the quench exchanger to eliminate voids and provide thermal stresses which are less extreme than prior art designs. The result is a mechanical design which is free from operation errors, such as, for example, wet or loss of steam, and is therefore more reliable.

In one aspect the present invention provides a thermal transition section for introducing a high temperature cracked process gas to a quench exchanger. The quench exchanger has an inlet end comprising inner and outer concentric pipes connected to a closure ring to define an annulus between the pipes. The thermal transition section includes a metal outer wall extending from a downstream end connected to the closure ring to an upstream end connected to a metal transition cone. A metal inner sleeve extends from an upstream end connected to the transition cone, to a downstream end received in the closure ring. The downstream end of the inner sleeve has an outside diameter matching an inside diameter of the interior exchanger surface. A metal inlet tube is connected at a downstream end to the transition cone, and connected in an upstream end to a line for supplying the process gas. A precast, pre-fired ceramic insert substantially fills an annulus between the outer wall and inner sleeve from adjacent the transition cone to adjacent the closure ring. A ratio of length of the ceramic insert to the outside diameter of the inner sleeve is preferably between 3 and 4.

The outer wall preferably has an outside diameter matching an outside diameter of the outer pipe of the quench exchanger. The transition cone preferably has an outside surface tapered from a large outside diameter adjacent the outer wall, to a small outside diameter adjacent to the inner sleeve. The transition section can also include a backup ring adjacent a welding seam between the transition cone and the outer wall wherein the backup ring has an outside diameter adjacent an inside diameter of the outer wall.

The thermal transition section preferably includes a layer of refractory mortar on the surface of the ceramic insert, and a cold gap between an outside diameter of the inner sleeve and an inside diameter of the ceramic insert to allow for differential thermal expansion of the inner sleeve.

In another aspect, the invention provides a method for assembling a thermal transition section for introducing a high temperature cracked process gas into a quench exchanger having an inlet and comprising inner and outer concentric pipes connected to a closure ring to define an annulus between the pipes and an interior exchanger surface having an inside diameter. The method includes the step of providing a metal outer wall section adjacent to the closure ring to extend upstream from the closure ring. A precast, pre-fired annular ceramic insert is fitted over a metal inner sleeve connected at an upstream end to a metal transition cone to form a ceramic insert-sleeve assembly. The transition cone has an exterior wall tapered from a large inside diameter at a downstream end to a small inside diameter adjacent to the upstream end of the inner sleeve. The inner sleeve has an outside diameter at a downstream end matching the inside diameter of the interior exchanger surface. The ceramic insert-sleeve assembly is inserted into the outer wall to position a downstream end of the inner sleeve in the closure ring, and to position the transition cone adjacent an upstream end of the outer wall, with the outside diameter of the inner sleeve in abutment with the inside diameter of the interior exchanger surface. The outer wall is welded to the transition cone.

The method preferably includes coating the surface of the ceramic insert with a layer of refractory mortar before the fitting and insertion steps. The refractory mortar is preferably non-aqueous based. Alternatively, the ceramic insert and refractory mortar can be heated, if necessary, after the insertion step to dry the refractory mortar before the welding step.

The transition cone in the fitting step preferably has a backup ring secured to the inside diameter of the exterior wall so as to overlap with an inside diameter of the upstream end of the outer wall in the insertion step and shield the ceramic insert during the welding step.

Preferably, an outer surface of the inner sleeve is wrapped with a combustible tape prior to the fitting step to form a cold gap between the inner sleeve and the ceramic insert to allow for differential thermal expansion of the inner sleeve.

The method can be used where the thermal transition section is assembled as a retrofit of an existing quench exchanger, or installed in a new quench exchanger construction.

The ceramic insert in the thermal transition section assembly method preferably has a length which is from 3 to 4 times the outside diameter of the inner sleeve.

In operation, process gas is passed through the inner sleeve in the quench exchanger. During normal operation, the ceramic insert section provides a gradual thermal transition between the hot process gas and boiler water. This gradual thermal transition is necessary to provide a design with acceptable stresses. During an upset, for example, the temperature of the process gas passed through the inner sleeve and the quench exchanger is suddenly varied, allowing the inner sleeve to expand and contract, and allowing the ceramic insert to shield the outer wall from thermal stresses induced by the temperature variation step.

DETAILED DESCRIPTION OF THE INVENTION

Figure 1:
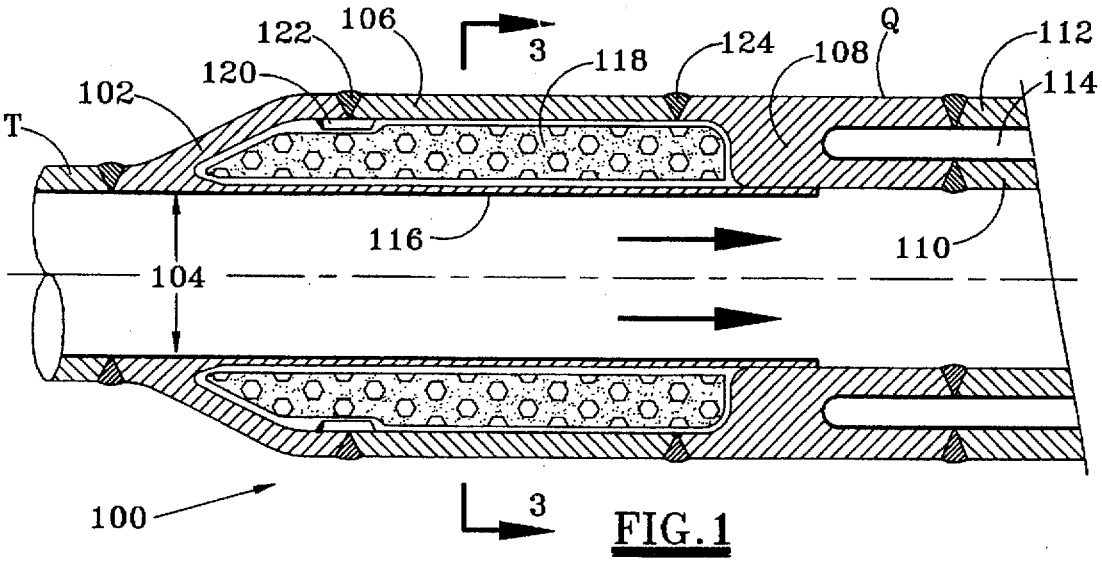
FIG. 1 is a side sectional view of a thermal transition section for a quench exchanger according to one embodiment of the present invention.

As seen in FIG. 1, the thermal transition section 100, according to one embodiment of the invention, is installed between an upstream transfer line T and a high temperature quench exchanger Q downstream. A transition cone 102 is welded at upstream transfer line T and tapers from the upstream end at a relatively small inside diameter 104 to a relatively large inside diameter adjacent an exterior wall 106. The wall 106 is generally tubular and has a downstream end welded adjacent to a closure ring 108 at an upstream end of the quench exchanger Q. The closure ring 108 is welded at a downstream end to inner wall 110 and outer wall 112 which form an annulus 114 through which boiler feedwater or another cooling fluid is circulated.

The exterior wall 106 generally has an outside diameter matching that of the closure ring 108 and outer wall 112. An inner sleeve 116 extends downstream from the transition cone 102 from adjacent the inside diameter 104. The inner sleeve 116 terminates at a downstream end adjacent the closure ring 108.

Hot hydrocarbon gases from a cracking furnace, for example, or another hot process stream to be quenched, are passed from the upstream line T, through the transition cone 102 and sleeve 116, through the closure ring 108 and the interior passage defined by the inner wall 110 in the quench exchanger Q where they are cooled by the cooling fluid circulated through the annulus 114, as described above.

Figure 3:
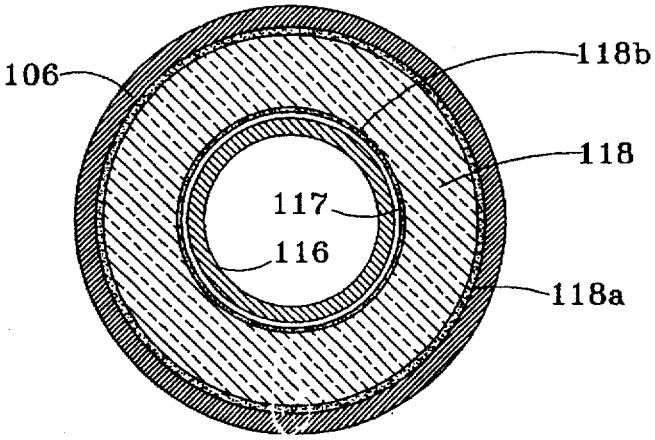
FIG. 3 is a cross-sectional view of the thermal transition section of FIG. 1 as seen along the lines 3—3.
Figure 4:
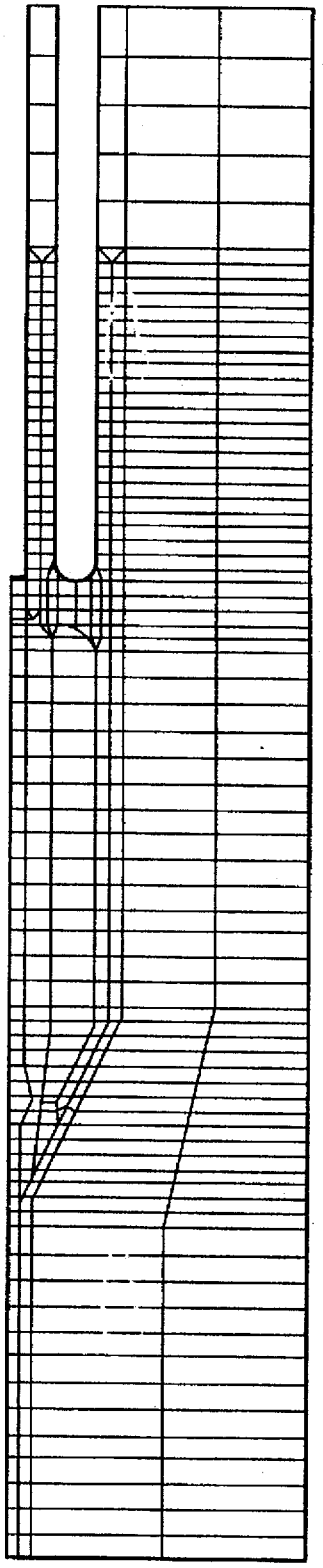
FIG. 4 is a finite element model showing overall nodes for finite element analysis of the thermal transition section of FIG. 1.

A ceramic insert 118 is disposed in an annulus between the exterior wall 106 and the inner sleeve 116 extending from adjacent the transition cone 102 to adjacent the closure ring 108. The ceramic insert 118 is preferably a precast., pre-fired single piece. The ceramic insert can be an alumina material such as is available under the trade designations LC-97, for example. Desirably, any gaps or voids between the ceramic insert 118 and an interior surface of the transition cone 102 and exterior wall 106 are filled with refractory mortar, and between the outer surface of the inner sleeve 116 and the inner surface of the ceramic insert 118, at 118*a*, 118*b*, except for a cold gap 117 (see FIG. 3) between the inner sleeve 116 and ceramic insert 118 to allow for differential thermal expansion of the two materials. If desired, a backup ring 120 may be disposed adjacent the downstream end of the transition cone 102 at an inner surface thereof across a weld seam 122.

Figure 2:
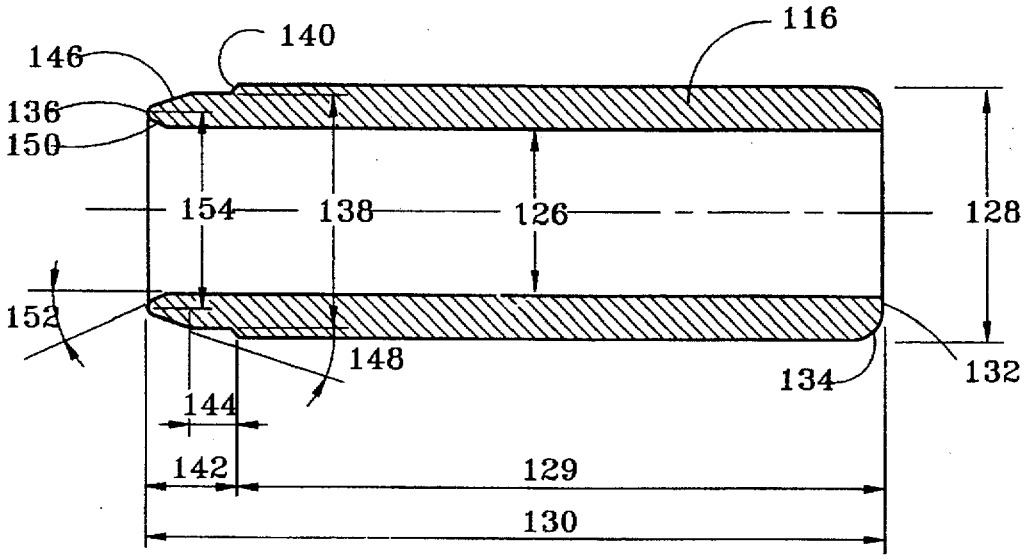
FIG. 2 is a side sectional view of a ceramic insert used in the thermal transition section of FIG. 1.

A preferred embodiment of the refractory insert 118 is seen in FIG. 2. The insert 118 has an inside diameter 126, an outside diameter 128 over the length 129, and an overall length 130. At downstream end 132, the outer edge 134 has a suitable radius to match that of the closure ring 108 (see FIG. 1).

At upstream end 136, the insert 118 is shaped to fit into the transition cone 102 (see FIG. 1). A reduced outside diameter 138 is formed adjacent the shoulder 140 to accommodate the backup ring 120 (see FIG. 1) which is positioned at a distance 142 from the upstream end 136 and runs along distance 144. The upstream end 136 has an outer surface 146 tapered outwardly at angle 148 with respect to a central axis, and inner surface 150 tapering inwardly at angle 152. The upstream end 136 is rounded where the surfaces 146, 150 join to complement a radius of curvature corresponding to the transition cone 102. The upstream end 136 has a diameter 154.

The transition section 100 is preferably assembled and installed after fabrication and hydrostatic testing of the quench exchanger Q. The transition cone 102 (including the backup ring 120 secured in place), exterior wall section 106 and ceramic insert 118 are inspected for specified tolerances, and if necessary, the ceramic insert 118 can be machined or ground. A layer of masking tape, or other thermally decomposable material, preferably no greater than 1/64-inch thickness, is installed on the outside diameter of the inner sleeve 116 for expansion purposes. Depending on the thickness of the tape, three or four layers may be needed. The tape thickness should be measured to determine the number of layers which are required. When the quench exchanger is brought up to operating temperature, the tape will decompose and form a cold gap between the ceramic insert 118 and the inner sleeve 116 to allow for differential thermal expansion between the insert 1t8 and the sleeve 116.

The exterior wall 106 is welded to the closure ring 108 at the weld seam 124. The dry ceramic insert 118 is trial fit into the transition cone 102 and the exterior wall 106 to check for fit. If necessary, the transition cone 102, exterior wall 106, closure ring 108 and/or inner sleeve 116 can be adjusted, or the surface of the ceramic insert 118 can be ground down to fit.

A small amount of refractory mortar, such as, for example, a 0.25 inch bead, is placed on the bottom of the transition cone 102. The refractory mortar is preferably made from a non-aqueous based formulation to avoid the need for dry out procedures, such as, for example, the dry formulation/liquid activator system available under the trade designation Thermbond from Stellar Materials which cures upon mixing in a fast exothermic set. The surface of ceramic insert 118 is coated with refractory mortar, being sure to completely immerse the ceramic insert 118, and the ceramic insert 118 is then placed in the annulus of the transition cone 102. The transition cone 102/ceramic insert 118 assembly is then placed into the exterior sleeve 106 and the downstream end of the transition cone 102 positioned adjacent to the upstream end of the exterior wall 106. Refractory mortar may squeeze out during the assembly, but it is essential that the mortar fill all gaps 118*a*, 118*b* between the refractory insert 118 and the transition cone 102, exterior wall 106, closure ring 108 and inner sleeve 116. The excess mortar is cleaned from the immediate areas, using a steel brush, for example, if necessary, and the exterior wall 106 is tack welded to the transition cone 102. Refractory mortar is also cleaned from the weld bevels on the adjacent ends of the transition cone 102 and exterior wall 106.

If an aqueous-based mortar is used, the assembly can be preheated to 200°–250° F., for a period of time sufficient to dry out the refractory mortar, typically four hours. The heating can be effected with a torch or with electric heating elements and thermocouples for better temperature control. If the refractory mortar is not sufficiently dried before beginning the welding, steam will form and can blow out the weld metal. After the refractory mortar is dried, the weld between the exterior sleeve 106 and transition cone 102 can be completed. The ceramic insert 116 is protected during the welding by the backup ring 120 which should straddle the weld seam 122. The integrity of the welding is checked with a conventional dye penetrant, and the quench exchanger placed in service.

For retrofitting an existing primary quench exchanger, it is preferred that the wall thicknesses of the existing inlet transition sections are measured to establish the "as built" dimensions and custom design the refractory insert 118 for the retrofit. The purge seam connection can be removed or blinded since this will no longer used. The existing transition section is cut out by making cuts approximately ⅛ inch shorter than the piece to be reinstalled. After disassembly, the resulting chamber is measured in comparison to the new ceramic insert 116. The final cut on the transition section is adjusted such that the annulus or chamber is 3/16 inch, plus or minus 1/16 inch, longer than the new refractory insert 118. The transition section is then reinstalled as per the new installation just described above. The welding is completed and checked with a conventional dye penetrant, heated to dry out the mortar, if necessary, and then placed in service for furnace operation.

In the operation of the furnace, the hot fluids from the transfer line T flow through the transition section 100 and into the quench exchanger Q. As the hot fluids enter the quench exchanger Q, boiler feedwater, steam or other cooling liquid is introduced to the annulus 114 to quench the hot fluids. The thermal transition is taken up between the inner sleeve 116 and refractory insert 118. Since the sleeve 116 is not secured at its downstream end, this can expand or contract against the closure ring 108 without adverse consequences. The refractory insert 118 maintains the exterior wall 106 at a reduced temperature to eliminate thermally stressing the exterior wall 106. The ceramic insert 118 fills the annulus between the inner sleeve 116 and exterior wall 106 to prevent hydrocarbons from forming in the annulus.

EXAMPLE

A finite element analysis (FEA) for stress of the transition section of the present invention was conducted and compared to the steam-purged, radiation-shielded annulus of the transition section of the prior art as the Base Case. Input parameters were based on propane feedstock operation with flows and temperatures taken from an actual ethylene plant. The node numbering for the FEA is shown in FIGS. 4–7.

Figure 5:
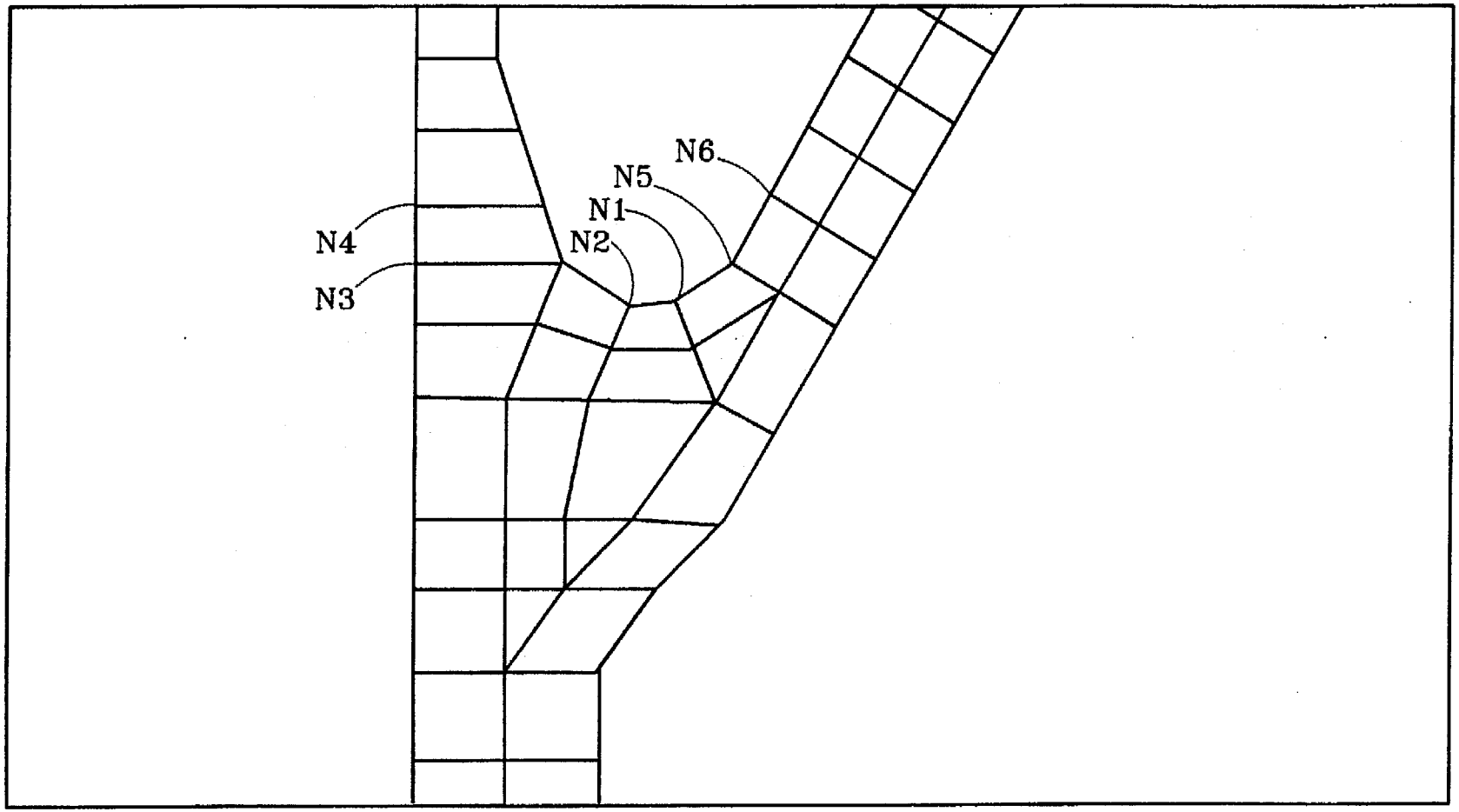
FIG. 5 is an enlarged section of the model of FIG. 4 showing node numbering at the inlet of the transition section.
Figure 6:
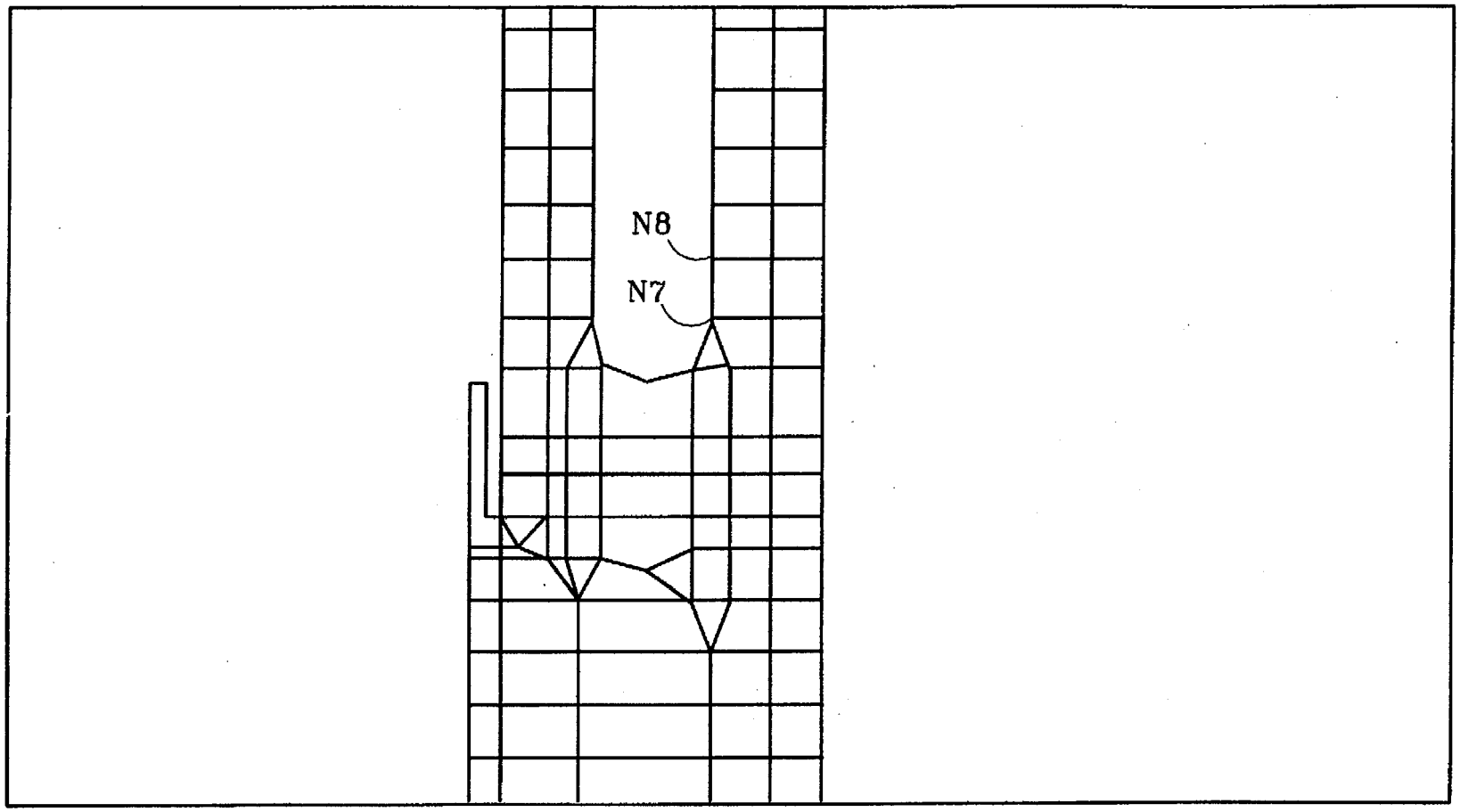
FIG. 6 is an enlarged section of the model of FIG. 4 showing node numbering at the outlet of the transition section.
Figure 7:
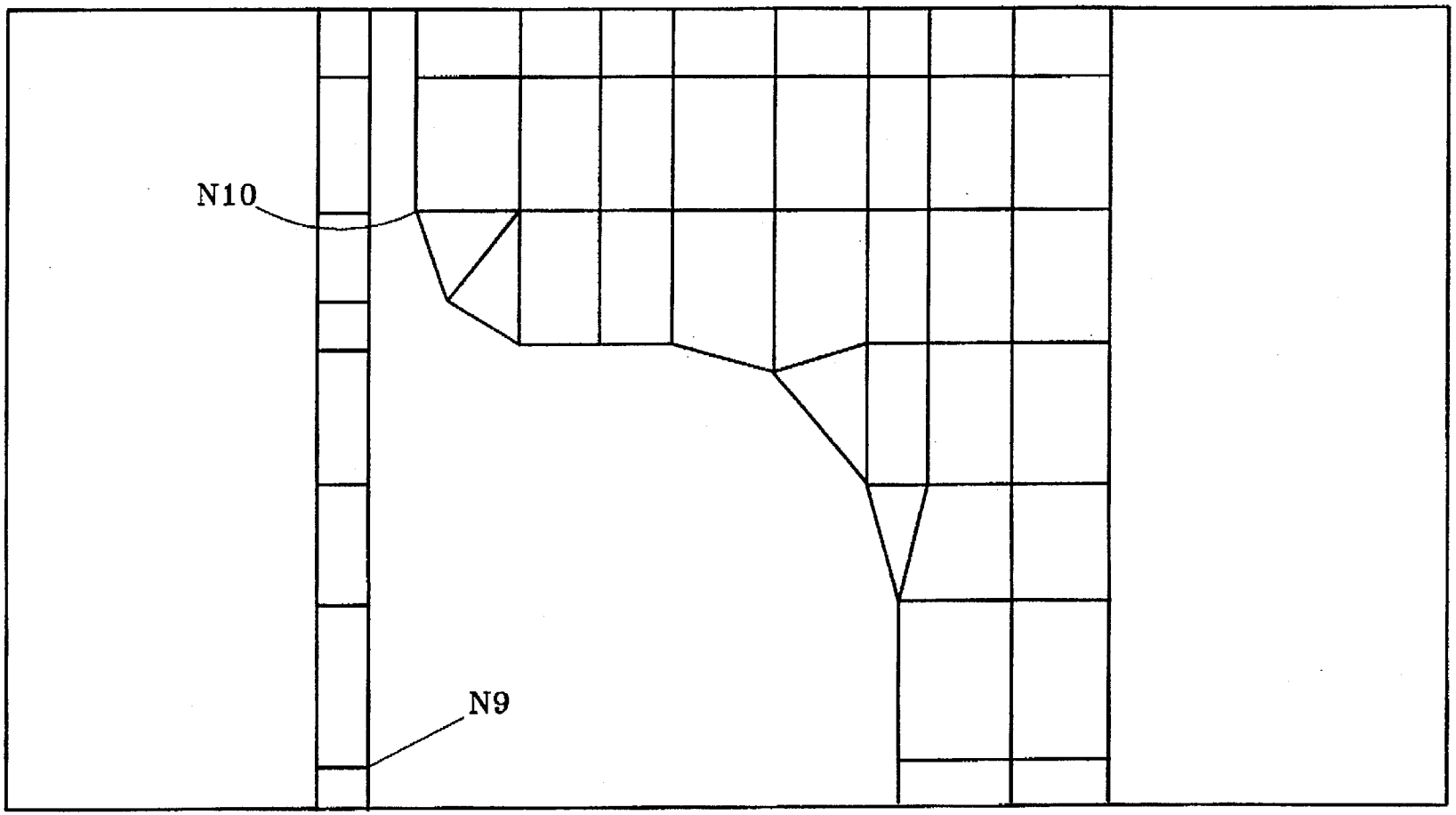
FIG. 7 is a further enlarged section of the model of FIG. 6 showing node numbering at the outlet adjacent to the refractory insert.

The nodes at the inlet end of the transition cone 102 showed the highest stresses, and are numbered as shown in FIG. 5. FEA stress analysis results of the steam-purged, radiation-shielded annulus of the prior art Base Case is presented in Table 1 below.

TABLE 1

| | | BASE CASE | | | |
|---|---|---|---|---|---|
| | | PRINCIPAL STRESSES AND STRESS INTENSITIES | | | |
| NODE NO. | TEMP | $\sigma_1$ (psi) | $\sigma_2$ (psi) | $\sigma_3$ (psi) | SI (psi) |
| N1 | 1565 | −330 | −1612 | −4748 | 4417 |
| N2 | 1571 | 991 | −2020 | −4252 | 5242 |
| N3 | 1589 | 748 | −3107 | −7033 | 7781 |
| N4 | 1589 | 4361 | 891 | −5262 | 9623 |
| N5 | 1560 | −1165 | −1534 | −6623 | 5458 |
| N6 | 1544 | 292 | −1754 | −10250 | 10550 |
| N7 | 608 | 30360 | 6753 | 796 | 29570 |
| N8 | 606 | 27070 | 4694 | −1286 | 28350 |

The next case examined was the inlet transition section according to the present invention, with the same dimensions as the steam-purged design of the Base Case, listed in Table 2 below.

TABLE 2

| | Dimensions |
|---|---|
| Insert Feature | |
| Inside diameter 126 | 2.75 ± 0.040 in |
| Outside diameter 128 | 4.625 ± 0.040 in. |
| Major length 129 | 7.3125 in. |
| Overall length 130 | 9.6695 in. |
| Radius 134 | 0.375 in. |
| Minor O.D. 138 | 4.25 ± 0.040 in; |
| Minor length 142 | 2.25 in. |
| Shoulder length 144 | 1.125 in. |
| Outer taper angle 148 | 29° |
| Inner taper angle 152 | 15° |
| Radius at end 136 | 0.125 in. |
| Transition Feature | |
| Inlet T O.D. | 3.0 in. |
| Inlet T I.D. | 2.25 ± 0.010 in. |

TABLE 2-continued

| | Dimensions |
|---|---|
| Exterior wall 106 I.D. | 4.75 ± 0.020 in. |
| Exterior wall 106 O.D. | 5.5 in. |
| Exterior wall 106 Thickness | 0.375 (+0.107/−0.000)in. |
| Upstream end to shoulder 140 | 3.5 in. |
| Upstream end to downstream end of sleeve 116 | 12.0 in. |

From the FEA results presented below in Table 3, it is seen that the stress intensities are approximately 15 percent lower at the inlet end of the transition cone 102 and about 15–20 percent higher on the boiler feedwater side of the closure ring 108, although still well below the allowable stresses.

TABLE 3

CERAMIC INSERT

| | | PRINCIPAL STRESSES AND STRESS INTENSITIES | | | | |
|---|---|---|---|---|---|---|
| NODE NO. | TEMP (°F.) | $\sigma_1$ (psi) | $\sigma_2$ (psi) | $\sigma_3$ (psi) | SI (psi) | Sy (psi) |
| N1 | 1583 | −2476 | −3561 | −9562 | 7086 | 11506 |
| N2 | 1590 | −693 | −3860 | −8403 | 7709 | 11380 |
| N3 | 1605 | 3512 | −1685 | −4515 | 8027 | 11110 |
| N4 | 1608 | 3809 | 275 | −3640 | 7450 | 11056 |
| N5 | 1577 | −1682 | −2632 | −9206 | 7524 | 11614 |
| N6 | 1567 | 83 | −947 | −5480 | 5563 | 11794 |
| N7 | 618 | 34402 | 17427 | 2738 | 31664 | |
| N8 | 611 | 33995 | 12939 | −1387 | 35382 | |

Another FEA was conducted using a longer transition section. It was found that using a ceramic insert 118 which was about two inches longer than the annulus of the steam-purged design reduced the stresses at the transition cone 102 another 25 percent, or about 40 percent lower than the prior art steam-purged design. A summary of these results is presented in Table 4 below.

TABLE 4

LONG CERAMIC INSERT

| | | PRINCIPAL STRESSES AND STRESS INTENSITIES | | | | |
|---|---|---|---|---|---|---|
| NODE NO. | TEMP (°F.) | $\sigma_1$ (psi) | $\sigma_2$ (psi) | $\sigma_3$ (psi) | SI (psi) | Sy (psi) |
| N1 | 1599 | −1755 | −2506 | −6773 | 5018 | 11220 |
| N2 | 1604 | −489 | −2762 | −6025 | 5536 | 11130 |
| N3 | 1615 | 2523 | −1233 | −3316 | 5838 | 10930 |
| N4 | 1617 | 2773 | 212 | −2688 | 5461 | 10890 |
| N5 | 1595 | −1170 | −1808 | −6439 | 5268 | 11290 |
| N6 | 1587 | 67 | −592 | −3720 | 3786 | 11430 |
| REFRACTORY STRESSES | | | | | | |
| N9 | | −547 | −3427 | −6486 | 5938 | |
| N10 | | 7090 | −840 | −3049 | 10139 | |

A thermal transient condition for the transition section according to the present invention was also reviewed to simulate the rapid cool down that occurs during a furnace trip. Field data from a typical furnace trip was used for calculation of input parameters for the model. The results indicated that stress reversal occurs with the maximum stress about 30 minutes after a furnace trip. All stresses remained within the allowable limits.

The invention is illustrated by way of the foregoing description. Various changes and modifications will occur to those skilled in the art in view of the foregoing. It is intended that all such modifications and variations within the scope and spirit of the appended claims be embraced thereby.

We claim:

1. A thermal transition section for introducing a high temperature cracked process gas into a quench exchanger having an inlet end comprising inner and outer concentric pipes connected to a closure ring to define an annulus between the pipes and an interior exchanger surface having an inside diameter, comprising:

a metal outer wall extending from a downstream end connected to the closure ring to an upstream end connected to a metal transition cone, wherein the transition cone is connected at an upstream end to a line for supplying the process gas;

a metal inner sleeve extending from an upstream end connected to the transition cone to a downstream end received in the closure ring, wherein the downstream end of the inner sleeve has an outside diameter matching the inside diameter of the interior exchanger surface;

a precast, pre-fired ceramic insert substantially filling an annulus between the outer wall and inner sleeve from adjacent the transition cone to adjacent the closure ring;

wherein a ratio of length of the ceramic insert to the outside diameter of the inner sleeve is between 3 and 4.

2. The thermal transition section of claim 1 wherein the outer wall has an outside diameter matching an outside diameter of the outer pipe of the quench exchanger.

3. The thermal transition section of claim 1 wherein the transition cone has an outside surface tapered from a large outside diameter adjacent the outer wall to a small outside diameter adjacent the inner sleeve.

4. The thermal transition section of claim 3 including a backup ring adjacent a weld seam between the transition cone and the outer wall, wherein the backup ring has an outside diameter adjacent an inside diameter of the outer wall.

5. The thermal transition section of claim 1 comprising a layer of refractory mortar on the surface of the ceramic insert.

6. The thermal transition section of claim 1 comprising a cold gap between an outside diameter of the inner sleeve and an inside diameter of the ceramic insert to allow for differential thermal expansion of the inner sleeve.

7. A method for assembling a thermal transition section for introducing a high temperature cracked process gas into a quench exchanger having an inlet end comprising inner and outer concentric pipes connected to a closure ring to define an annulus between the pipes and an interior exchanger surface having an inside diameter, comprising the steps of:

providing a metal outer wall section adjacent to the closure ring to extend upstream from the closure ring;

fitting a precast, pre-fired annular ceramic insert over a metal inner sleeve connected at an upstream end to a metal transition cone to form a ceramic insert-sleeve assembly, wherein the transition cone has an exterior wall tapered from a large inside diameter at a downstream end to a small inside diameter adjacent the upstream end of the inner sleeve and wherein the inner sleeve has an outside diameter at a downstream end matching the inside diameter of the interior exchanger surface;

inserting the ceramic insert-sleeve assembly into the outer wall to position a downstream end of the inner sleeve in the closure ring and the transition cone adjacent an upstream end of the outer wall wherein the outside diameter of the inner sleeve abuts the inside diameter of the interior exchanger surface;

welding the outer wall to the transition cone.

8. The method of claim 7 comprising coating the surface of the ceramic insert with a layer of refractory mortar before the fitting and insertion steps.

9. The method of claim 8 wherein the refractory mortar is non-aqueous based.

10. The method of claim 7 wherein the transition cone in the fitting step has a backup ring secured to the large inside diameter of the exterior wall so as to overlap with an inside diameter of the upstream end of the outer wall in the insertion step and shield the ceramic insert during the welding step.

11. The method of claim 7 comprising the step of wrapping an outer surface of the inner sleeve with a combustible tape prior to the fitting step to form a cold gap between the inner sleeve and the ceramic insert to allow for differential thermal expansion of the inner sleeve.

12. The method of claim 7 wherein the thermal transition section is assembled as a retrofit of an existing quench exchanger.

13. The method of claim 7 wherein the ceramic insert has a length which is from 3 to 4 times the outside diameter of the inner sleeve.

14. The method of claim 7, further comprising the steps of passing the process gas through the inner sleeve and the quench exchanger, suddenly varying the temperature of the process gas passed through the inner sleeve and the quench exchanger, allowing the inner sleeve to expand and contract, and allowing the ceramic insert to shield the outer wall from thermal stresses induced by the temperature variation step.

* * * * *